United States Patent [19]

Homer et al.

[11] 4,136,633

[45] Jan. 30, 1979

[54] DEVICE FOR RESTRAINING LATERAL MOVEMENT OF SUBSEA EQUIPMENT

[75] Inventors: Joseph F. Homer; John L. Glaeser; Robert P. Bright, all of Anchorage, Ak.

[73] Assignee: Exxon Production Research Company, Houston, Tex.

[21] Appl. No.: 803,816

[22] Filed: Jun. 6, 1977

[51] Int. Cl.[2] ..... B63B 35/44

[52] U.S. Cl. ..... 114/264; 166/341; 175/5; 214/1 P; 267/140

[58] Field of Search ..... 9/8 P; 214/1 P, 13; 114/220, 264, 244, 265, 258, 181; 175/5, 7; 166/0.5; 267/141, 140, 136, 139, 152, 153; 29/148.4 D

[56] References Cited

U.S. PATENT DOCUMENTS

| | | | |
|---|---|---|---|
| 2,952,979 | 9/1960 | Rolando | 114/220 X |
| 3,528,497 | 9/1970 | Lehman | 175/7 X |
| 3,895,677 | 7/1975 | Bokenkamp | 166/0.5 |

*Primary Examiner*—Trygve M. Blix
*Assistant Examiner*—Sherman D. Basinger
*Attorney, Agent, or Firm*—J. S. Schneider

[57] ABSTRACT

A device is disclosed for restraining lateral movement of large underwater equipment, such as a blowout preventer (BOP) stack for use on subsea wells, when retrieving or running such equipment through the well of a floating vessel. A plurality of rollers are angularly positioned about the well, each roller being capable of rolling longitudinally (vertically) along the equipment. Each roller is connected to shock absorbers for cushioning lateral movement of the equipment and to a piston cylinder for moving each roller toward and away from the equipment.

4 Claims, 4 Drawing Figures

FIG. 1.
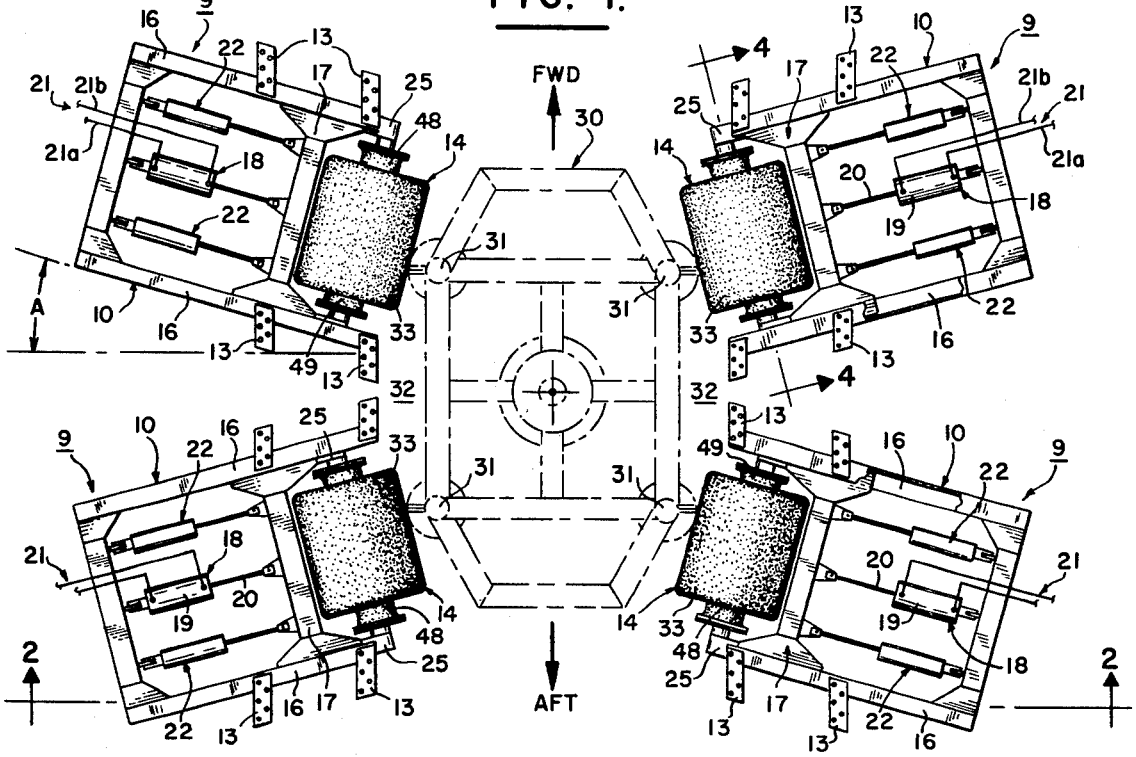
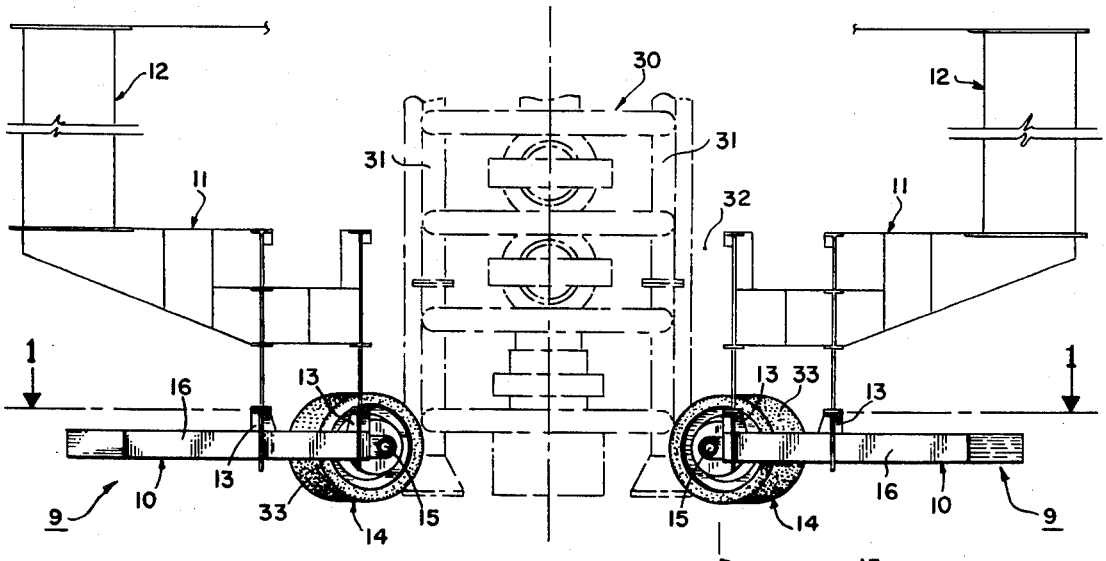
FIG. 2.
FIG. 3.
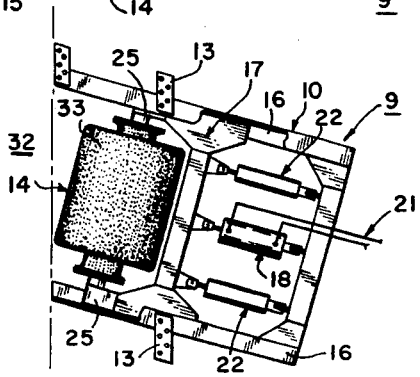

DEVICE FOR RESTRAINING LATERAL MOVEMENT OF SUBSEA EQUIPMENT

BACKGROUND OF THE INVENTION

This invention concerns a device for use on a floating vessel and, particularly, a device capable of restraining lateral movement of equipment being raised or lowered through the well of the vessel. More specifically, the invention concerns a device for use on a floating drilling vessel to restrain lateral movement of a subsea BOP stack being raised or lowered through the well of the vessel.

The possibility of injury to personnel and damage to large subsea equipment, such as BOP stacks and risers and/or main structure members, in the celler deck of floating vessels, such as semisubmersible drilling vessels, is extremely high when retrieving or running such subsea equipment during rough weather. A solution, which minimizes personnel danger and possible equipment and structural damage and yet permits operations to continue, is to stop the subsea equipment from swinging in the well of the floating vessel by means of a capturing device. Because of the large forces involved it is necessary that such device be capable of first cushioning and slowing horizontal movements of the subsea equipment and, second, of holding the subsea equipment stationary. For optimum and efficient use such device must be quick acting and be so constructed and located that it will not interfer with normal functions, e.g. drilling operations, of the vessel. The device of the present invention satisfies all of the foregoing requirements.

SUMMARY OF THE INVENTION

Briefly, this invention concerns a device for restraining movement of subsea equipment when retrieving and running such equipment through the well of a floating vessel. A plurality of rollers are angularly positioned about the well with each roller being connected to means for cushioning lateral movement of the subsea equipment and to means for moving each roller laterally toward and away from the equipment in the well.

BRIEF DESCRIPTION OF THE DRAWINGS

FIG. 1 is a plan view of the device of the present invention in operational position;

FIG. 2 is a view taken along line 2—2 of FIG. 1;

FIG. 3 is a plan view of one of the roller-frame assemblies of the present invention illustrating the roller in fully retracted position.

DESCRIPTION OF THE PREFERRED EMBODIMENTS

Figure 4:
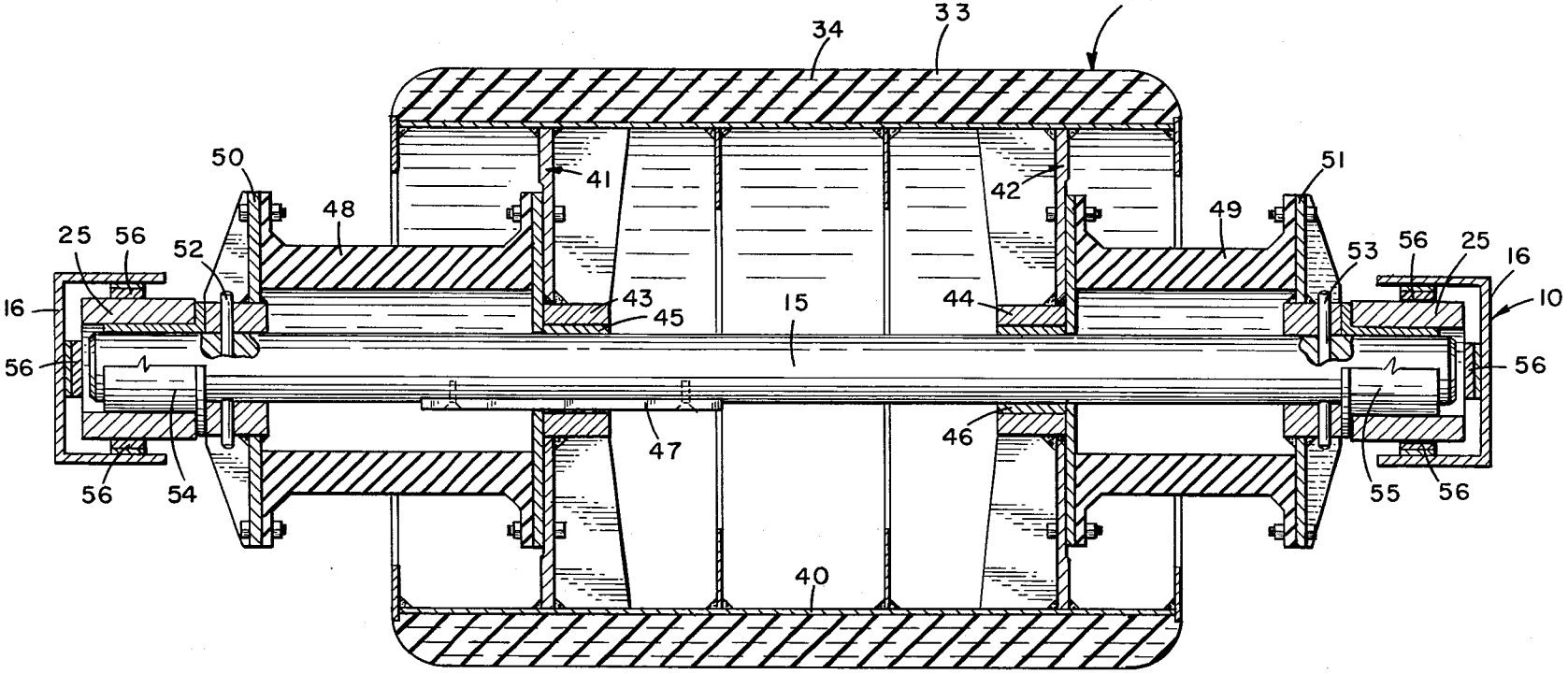
FIG. 4 is a sectional view taken along line 4—4 of FIG. 1.

Referring to the drawings, and particularly FIG. 1, there are shown four identical roller-frame assemblies 9. Each frame assembly includes a frame 10, mounted under a cellar deck 11 adjacent a well 32 of a floating drilling vessel 12 (see FIG. 2) by means of brackets 13, and a roller or drum 14 supported and rotatable on an axle shaft 15 which extends axially in a substantially horizontal direction through roller 14. Shaft 15 is, in turn, rotatable in end bearing blocks 25 which are supported and slidable in parallel tracks formed by "U" shaped channel beams 16 of frame 10. The ends of a sliding beam 17, which are also supported and slidable on channel beams 16, are connected to blocks 25. An actuator (air cylinder) 18 includes a cylinder 19 connected to frame 10 and a piston rod 20 connected to sliding beam 17 at one end and to a piston, not shown, within cylinder 19 at the other end thereof. Piping 21 supplies and exhausts air (or other fluid) pressure to and from, respectively, either end of cylinder 19 to cause the piston in cylinder 19 and piston rod 20 to move laterally back and forth within frame 10. A shock absorber assembly 22, having one end connected to frame 10 and the other end thereof connected to sliding beam 17, is located on each side of actuator 18.

A BOP stack 30 having four guideposts 31 is shown located in well 32 of drilling vessel 12. Each frame 10 with its associated roller 14, shock absorber assemblies 22 and actuator 18 is angled, as shown in FIG. 1, so that rollers 14 contact guideposts 31 in a manner which prevents, or minimizes, lateral movement of BOP stack 30 in any direction.

In FIG. 4 the structure and mounting of roller 14 in frame 10 are shown in more detail. A rubber sleeve 33, which may be reinforced by nylon canvas 34, is fixed to the outer cylindrical surface 40 of drum 14. Spaced apart hub flanges 41 and 42 are attached to the inner cylindrical surface of drum 14 and to inner hub members 43 and 44, respectively. Hub members 43 and 44 are concentric to the axis of axle shaft 15 of drum 40 and are provided with sleeve bearings 45 and 46, respectively, through which axle shaft 15 extends. Roller 14 is keyed to shaft 15 by a key 47 secured to shaft 15 which causes shaft 15 to rotate with drum 14 and, also, allows drum 14 to slide along shaft 15 in an axial or longitudinal direction. A heavy rubber sleeve 48 is mounted about one end of axle shaft 15 between hub flange 41 and an outer flange 50 by means of bolts, as shown, and, similarly, a heavy rubber sleeve 49 is mounted about the other end of axle shaft 15 between hub flange 42 and an outer flange 51. Outer flanges 50 and 51 are fixed to shaft 15 by removable pins 52 and 53, respectively. The ends of shaft 15 extend beyond outer flanges 51 and 52 and are mounted for rotation in sleeve bearings 54 and 55 which are positioned in bearing blocks 25 which are, in turn, attached to the ends of sliding beam 17. Blocks 25 and beam 17 slide on plate bearing 56 which are attached to the inner walls of U-shaped tracks 16 of frame 10. Cylindrical rubber sleeves 48 and 49 act as transverse, with respect to the axis of shaft 15, cushions or shock absorbers to eliminate some abrasion between BOP stack 30 and rollers 14 when BOP stack 30 moves against rollers 14, particularly when the BOP stack moves in generally fore or aft directions.

As seen more clearly in FIG. 4, sleeve 48 is longer than sleeve 49. As shown in FIG. 1, in the two forwardly positioned frame assemblies 9 long sleeves 48 are forward of sleeves 49 while in the aft positioned frame assemblies 9 long sleeves 48 are aft of sleeves 49. The size of the sleeves 48 and 49 may be determined by the amount of shock to be absorbed. Both of the sleeves can be the same length. In the arrangement of FIG. 1 frames 10 are positioned at an angle A (approximately 15°) to a plane vertically through the center of BOP stack 30 when the BOP stack is approximately centrally positioned in the well. Increasing angle A would reduce thrust forces in a direction longitudinally to shaft 15 and increase thrust forces in a direction transversely to that shaft. Increased or decreased angularity may be determined by the design of the substructure of the vessel on which the capturing device is installed and the dimensions of the capturing device components.

Controls for operation of the capturing device are preferably mounted in a single control console. When running and retrieving BOP stack 30 through well 32 of drilling vessel 12 in rough seas, which might cause BOP stack 30 to swing and possibly damage itself or structural portions of the drilling vessel, rollers 14 are actuated by applying fluid (gas) pressure to piping 21*a* to move piston rod 20 and sliding beam 17 and roller 14 toward BOP stack 30. Shock absorber assemblies 22 absorb energy resulting from movement of BOP 30 in a direction transversely to shaft 15. Shock absorbers 48 and 49 absorb energy forces resulting from movement of BOP stack 30 in a direction longitudinally to shaft 15. In the position of frame assemblies 9 shown in FIG. 1 rollers 14 provide a capture function which maintains BOP stack 30 laterally stationary. During raising or lowering operations of BOP stack 30 rollers 14 roll along the surface of guideposts 31 of BOP stack 30. Applying fluid pressure to control pipe 21*b* moves piston rod 20 and sliding beam 17 and roller 14 away from BOP stack 30 in well bay 32 to the retracted position of roller 14 shown in FIG. 3. Each roller 14 can be individually reciprocated toward and away from BOP stack 30 and well 32 for flexibility of operations. The controls operate to provide a retract function, as shown in FIG. 3, to keep rollers 14 clear of well 32 and out of the way of drilling equipment during normal drilling operations, an extend function to provide cushioning or shock absorbing action during capture of BOP stack 30 and a capture function, as shown in FIGS. 1 and 2, to permit actuators 18 to hold rollers 14 tight against each BOP stack post 31 to maintain the BOP stack laterally stationary.

Although shock absorber assemblies 22 are illustrated as piston-cylinder-type motion dampeners, other type shock absorbers could be used instead. Also, instead of the heavy cylindrical sleeves used to absorb forces transverse to the axis of the rollers other types of energy absorbers, such as fluid dampeners, could be used. Further, other types of actuators could be used in place of the air (fluid) pressure operated ones illustrated. For example, rods 20 could be electrically or mechanically actuated instead of being operated by fluid pressure. More than one actuator for each roller could be used and one, or more than two, shock absorbers could be employed with each roller. In addition, two, three, or more than four rollers might be used in place of the four illustrated so long as the rollers are capable of cushioning and holding the BOP stack stationary. The capturing device is also capable of being employed on any floating vessel or unit conducting industrial or scientific work otherwise, or in addition to, oil well operations. An oceanographic ship, for example, might use the device when raising or lowering scientific equipment to the ocean floor or a mining vessel might use the device when raising or lowering a bottom crawler through a well within the vessel.

Other changes and modifications may be made in the illustrative embodiments of the invention shown and described herein without departing from the scope of the invention as defined in the appended claims.

Having fully described the apparatus, advantages and objects of our invention we claim:

1. A device for restraining movement of a blowout preventor stack when moving said apparatus through the well of a floating vessel comprising:

a plurality of angularly spaced-apart means secured to said vessel for engaging and restraining lateral movement of said stack;

each of said spaced-apart means including:

a rigid frame assembly connected to said vessel;

a roller mounted for slidable movement on said frame assembly and capable of rolling along the surface of said stack;

shock absorber means connecting said roller and said frame assembly; and actuator means connected to said roller for moving said roller into and away from engagement with said stack.

2. A device as recited in claim 1 including means mounted on each end of said roller for absorbing energy forces in a direction transverse to the axis of said roller.

3. A device as recited in claim 1 in which said roller is slidable in a direction along its axis and means are arranged on each end of said roller for absorbing energy forces in a direction longitudinal to the axis of said roller.

4. A device for restraining movement of a blowout preventer stack when lowering and raising said stack through the well of a vessel comprising:

four spaced-apart frame members connected to said vessel adjacent said well; each frame member containing:

a roller capable of rolling along the surface of said stack and laterally movable to and from said stack;

a sliding beam connected to said roller;

two shock absorbers connected between each frame member and each sliding beam;

an actuator connected to said sliding beam for moving said sliding beam and roller laterally into and away from engagement with said stack; and means mounted on each end of each roller for absorbing energy forces in a direction longitudinal to the axis of said roller, said roller being slidable in a direction longitudinal to the axis of said roller.

* * * * *